US009709068B2

(12) United States Patent
Thompson et al.

(10) Patent No.: US 9,709,068 B2
(45) Date of Patent: Jul. 18, 2017

(54) SEALING ARRANGEMENT FOR FUEL CELL COMPRESSOR

(71) Applicant: Honeywell International Inc., Morristown, NJ (US)

(72) Inventors: Glenn F. Thompson, Palos Verdes Estates, CA (US); Rick Johnson, Torrance, CA (US); John Mason, Torrance, CA (US); Mike Guidry, Redondo Beach, CA (US); Patrick Beresewicz, La Mirada, CA (US)

(73) Assignee: Honeywell International Inc., Morristown, NJ (US)

( * ) Notice: Subject to any disclaimer, the term of this patent is extended or adjusted under 35 U.S.C. 154(b) by 725 days.

(21) Appl. No.: 14/184,122

(22) Filed: Feb. 19, 2014

(65) Prior Publication Data

US 2015/0233384 A1 Aug. 20, 2015

(51) Int. Cl.
*F04D 19/02* (2006.01)
*F04D 29/16* (2006.01)

(52) U.S. Cl.
CPC ..... *F04D 29/164* (2013.01); *F04D 19/02* (2013.01)

(58) Field of Classification Search
CPC .. F04D 29/102; F04D 29/5806; F04D 17/125; F04D 25/0606
See application file for complete search history.

(56) References Cited

U.S. PATENT DOCUMENTS 2,267,262 A * 12/1941 Bast ..... F04C 18/344 277/580
3,941,506 A * 3/1976 Robb ..... F04D 25/163 403/356
4,068,612 A 1/1978 Meiners
5,020,319 A 6/1991 Matsuura et al.
(Continued)

FOREIGN PATENT DOCUMENTS

CN 103 490 559 A 1/2014
DE 10 2008 054265 A1 5/2010
(Continued)

OTHER PUBLICATIONS

European Search Report for Application No. EP 15 15 8472 dated Sep. 24, 2015.
(Continued)

*Primary Examiner* — Woody Lee, Jr.
(74) *Attorney, Agent, or Firm* — Alston & Bird LLP

(57) ABSTRACT

A mechanism for differential pressure sealing for use in a compressor, such as for fuel cell applications, is described. In a dual-stage compressor, a low pressure side and/or a high pressure side of the dual-stage compressor may include a compressor wheel supported by a shaft that can rotate about an axis of the shaft. A seal carrier may be provided that rotates with the compressor wheel and includes a groove for receiving a sealing ring, which may be a split expansion ring. A static seal plate may be positioned around a periphery of a portion of the seal carrier, such that the sealing ring can seal against a contact surface of the static seal plate when
(Continued)

received in the groove in order to create a pressure differential seal. The low pressure side may include one sealing ring, whereas the high pressure side may include two sealing rings positioned in series.

14 Claims, 8 Drawing Sheets

(56) References Cited

U.S. PATENT DOCUMENTS

| | | | | |
|---|---|---|---|---|
| 5,350,039 | A * | 9/1994 | Voss | F04D 25/06 184/104.1 |
| 6,422,838 | B1 | 7/2002 | Sloteman | |
| 6,783,338 | B2 * | 8/2004 | Moroi | F04C 18/0284 418/178 |
| 8,317,494 | B2 | 11/2012 | Pileski et al. | |
| 8,348,640 | B2 | 1/2013 | Marioni | |
| 2003/0059315 | A1 | 3/2003 | Choi et al. | |
| 2004/0179947 | A1 | 9/2004 | Agrawal et al. | |
| 2006/0010880 | A1 * | 1/2006 | Kim | F01D 11/003 60/805 |
| 2007/0036662 | A1 * | 2/2007 | Pesola | F04D 17/12 417/350 |
| 2007/0052307 | A1 | 3/2007 | Yoshida et al. | |
| 2008/0223557 | A1 | 9/2008 | Fulton et al. | |
| 2008/0268695 | A1 | 10/2008 | Dieterle et al. | |
| 2008/0273990 | A1 | 11/2008 | Pham et al. | |
| 2011/0243762 | A1 | 10/2011 | Daikoku et al. | |
| 2013/0207494 | A1 | 8/2013 | Patel et al. | |
| 2013/0257201 | A1 | 10/2013 | Lemke et al. | |

FOREIGN PATENT DOCUMENTS

| | | | |
|---|---|---|---|
| DE | 10 2008 059002 | A1 | 7/2010 |
| EP | 1 479 335 | A2 | 11/2004 |
| EP | 2 910 789 | A1 | 8/2015 |
| FR | 2 982 094 | A1 | 5/2013 |
| GB | 2 335 710 | A | 9/1999 |
| GB | 2 427 248 | A | 12/2006 |
| JP | 2007 159179 | A | 6/2007 |
| WO | WO 00/49296 | A1 | 8/2000 |
| WO | WO 2004/063535 | A1 | 7/2004 |
| WO | WO 2006/005355 | A1 | 1/2006 |
| WO | WO 2011/066981 | A2 | 6/2011 |

OTHER PUBLICATIONS

European Search Report for Application No. EP 15 16 3597 dated Sep. 25, 2015.

European Search Report for Application No. EP 15 16 3723 dated Jan. 5, 2016.

Notice of Allowance for U.S. Appl. No. 14/265,664 dated Aug. 23, 2016.

Office Action for European Application No. 15 163 723.8 dated Jul. 29, 2016.

Extended European Search Report from corresponding European Patent Application No. 15153719.8 dated Jul. 6, 2015.

U.S. Appl. No. 14/226,309, filed Mar. 26, 2014, In re: Thompson et al., entitled *Electric Motor-Driven Compressor Having a Heat Shield Forming a Wall of a Diffuser*.

U.S. Appl. No. 14/265,664, filed Apr. 30, 2014, In re: Thompson et al., entitled *Electric Motor-Driven Compressor Having an Electrical Terminal Block Assembly*.

U.S. Appl. No. 14/264,677, filed Apr. 29, 2014, In re: Thompson et al., entitled *Electric Motor-Driven Compressor Having B-Directional Liquid Coolant Passage*.

* cited by examiner

SEALING ARRANGEMENT FOR FUEL CELL COMPRESSOR

CROSS-REFERENCE TO RELATED APPLICATION

The present application is related to commonly owned, co-pending application Ser. No. 14/226,309 filed on Mar. 26, 2014.

BACKGROUND

The present invention relates to seals used in compressors, such as dual-stage or series compressors used in fuel cell applications.

Air compressors can be used to increase the efficiency of a fuel cell by providing compressed air to the cathode side of the fuel cell. A dual-stage compressor may be used in some applications requiring a higher pressure at the outlet by compressing a volume of air in stages. In a dual-stage compressor, a low pressure compressor wheel is provided on a shaft, and a high pressure compressor wheel is provided on the same shaft. The shaft may be motor-driven, and rotation of the shaft may serve to rotate the compressor wheels. In this way, air at atmospheric temperature and pressure entering the low pressure side of the dual-stage compressor is compressed to a first pressure. The compressed air is then passed on to the high pressure side for a further increase in pressure. The air from the high pressure side of the dual-stage compressor is then delivered to the fuel cell to promote the fuel cell reaction.

Regardless of the particular configuration of the compressor, whether single-stage or dual-stage, the compressor generally defines various flow paths for air at different pressures.

BRIEF SUMMARY

Embodiments of the present invention are directed to mechanisms for providing seals between different flow paths within a compressor. Embodiments of the invention provide seals that are configured to separate and manage air at different pressures and temperatures, including compressor air, thrust bearing cooling air, and/or journal bearing cooling air, for example. Moreover, embodiments of the invention described herein provide seals that are low-cost, low-friction seals and can be used for high speed turbomachinery, including differential pressure sealing within a dual-stage compressor.

In one embodiment, for example, a dual-stage compressor for use with a fuel cell is provided that includes a low pressure side and a high pressure side. The low pressure side comprises a low pressure compressor wheel supported by a shaft and configured to rotate about an axis of the shaft; a low pressure seal carrier configured to rotate with the low pressure compressor wheel; a static low pressure seal plate disposed around a periphery of a portion of the low pressure seal carrier; and at least one low pressure sealing ring. The high pressure side comprises a high pressure compressor wheel supported by the shaft and configured to rotate about the axis of the shaft; a high pressure seal carrier configured to rotate with the high pressure compressor wheel; a static high pressure seal plate disposed around a periphery of a portion of the high pressure seal carrier; and at least one high pressure sealing ring. The low pressure seal carrier may define at least one seal groove configured to receive the low pressure sealing ring. The low pressure sealing ring may be configured to seal against a contact surface of the static low pressure seal plate when received in the groove in order to create a pressure differential seal for the low pressure side. Furthermore, the high pressure seal carrier may define at least one seal groove configured to receive the high pressure sealing ring, and the high pressure sealing ring may be configured to seal against a contact surface of the static high pressure seal plate when received in the groove in order to create a pressure differential seal for the high pressure side.

In some embodiments, at least one of the low pressure sealing ring or the high pressure sealing ring may comprise a split expansion ring. The low pressure seal carrier may, in some cases, define only one seal groove configured to receive a single low pressure sealing ring, and the high pressure seal carrier may define two seal grooves spaced apart from each other and each configured to receive a single high pressure sealing ring. Furthermore, the static high pressure seal plate may include a stepped section on the contact surface thereof, and the stepped section may be configured to limit axial travel of the high pressure sealing ring. The high pressure side may comprise an inner high pressure sealing ring and an outer high pressure sealing ring, and the high pressure seal carrier may define an inner seal groove configured to receive the inner high pressure sealing ring and an outer seal groove, spaced apart from the inner seal groove, configured to receive the outer high pressure sealing ring. The stepped section of the static high pressure seal plate may be configured to abut the inner high pressure sealing ring so as to limit axial travel of the inner high pressure sealing ring in a direction towards the low pressure side.

In some cases, the low pressure sealing ring and the high pressure sealing ring may be constructed of a low friction metallic material. The at least one high pressure sealing ring may have a diametral size that is different than a diametral size of the at least one low pressure sealing ring. The diametral size of the at least one high pressure sealing ring may be smaller than the diametral size of the at least one low pressure sealing ring. In some cases, the low pressure seal carrier and the high pressure seal carrier may be constructed of non-magnetic materials. Furthermore, the static low pressure seal plate and the static high pressure seal plate may be constructed of non-magnetic materials.

In other embodiments, a compressor for use with a fuel cell is provided, where the compressor includes a compressor wheel supported by a shaft and configured to rotate about an axis of the shaft, and a seal carrier configured to rotate with the compressor wheel, where the seal carrier defines at least one seal groove in a peripheral edge of the seal carrier. A static seal plate may be disposed around a periphery of a portion of the seal carrier, and at least one sealing ring may be provided that is configured to be received within the corresponding seal groove, such that the sealing ring seals against a contact surface of the static seal plate when received in the groove in order to create a pressure differential seal between a compressor side of the sealing ring and a shaft side of the sealing ring.

In some cases, the at least one sealing ring may comprise a split expansion ring. The seal carrier may define two seal grooves spaced apart from each other and each configured to receive a single sealing ring. Moreover, the static seal plate may include a stepped section on the contact surface thereof, wherein the stepped section is configured to limit axial travel of the sealing ring. The at least one sealing ring may comprise an inner sealing ring and an outer sealing ring, and the seal carrier may include an inner seal groove configured to receive the inner sealing ring and an outer seal groove, spaced apart from the inner seal groove, configured to receive the outer sealing ring. The stepped section of the static seal plate may be configured to abut the inner sealing ring so as to limit axial travel of the inner sealing ring. The sealing ring may be constructed of a low friction metallic material. In some cases, the seal carrier may be constructed of a non-magnetic material, and/or the static seal plate may be constructed of a non-magnetic material.

BRIEF DESCRIPTION OF THE SEVERAL VIEWS OF THE DRAWING(S)

Having thus described the present disclosure in general terms, reference will now be made to the accompanying drawings, which are not necessarily drawn to scale, and wherein:

DETAILED DESCRIPTION OF THE DRAWINGS

The present invention now will be described more fully hereinafter with reference to the accompanying drawings in which some but not all embodiments of the invention are shown. Indeed, aspects of the invention may be embodied in many different forms and should not be construed as limited to the embodiments set forth herein; rather, these embodiments are provided so that this disclosure will satisfy applicable legal requirements. Like numbers refer to like elements throughout.

Figure 1:
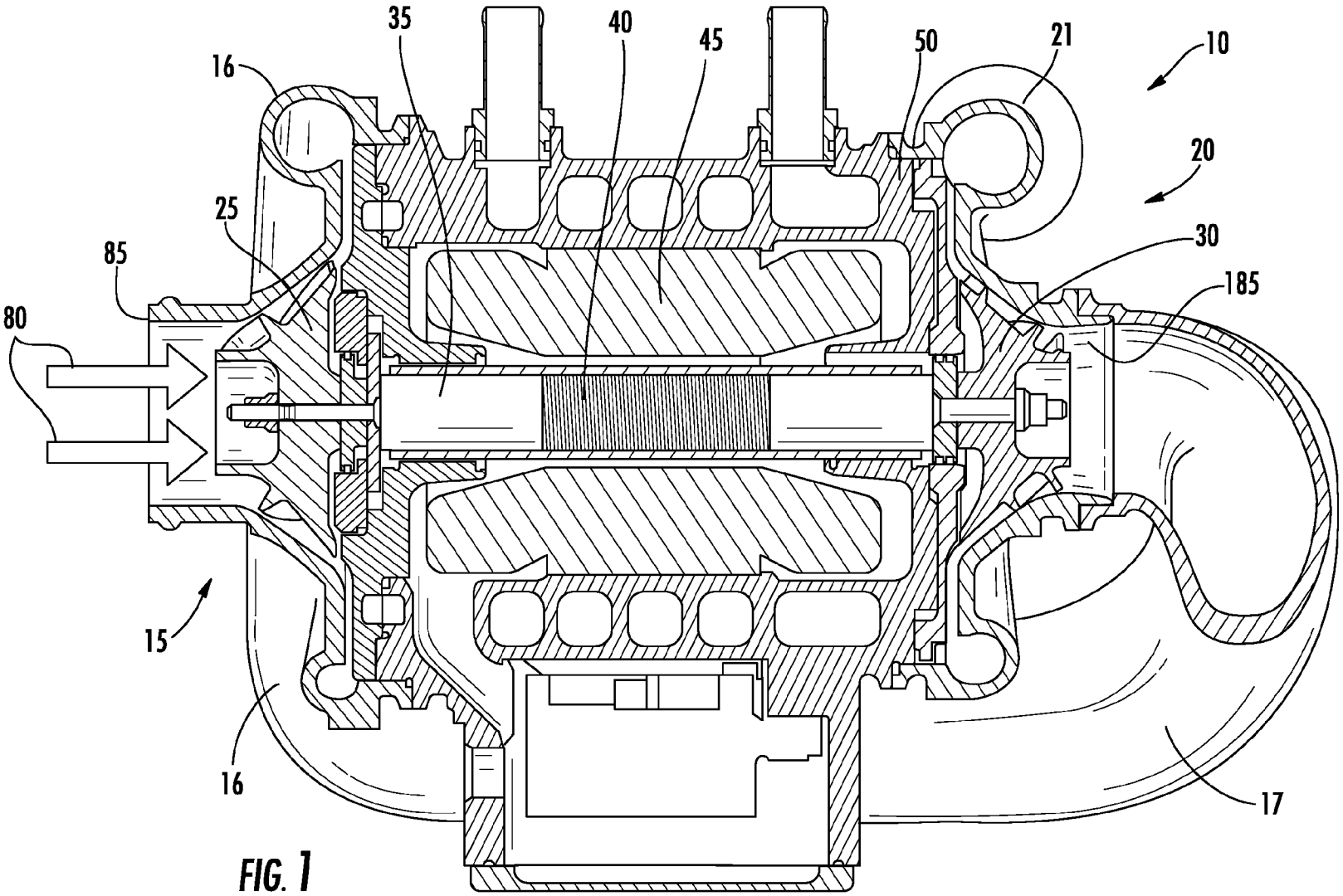
FIG. 1 is a simplified cross-sectional view of a dual-stage compressor in accordance with one embodiment of the invention.

A simplified cross-sectional view of a dual-stage compressor 10 for use with a fuel cell (such as a proton exchange membrane (PEM) fuel cell) is shown in FIG. 1. The dual-stage compressor 10 may include a low pressure side 15 and a high pressure side 20 at respective ends of the compressor. The low pressure side 15 may include a low pressure compressor wheel 25 that draws in ambient air at approximately atmospheric pressure and temperature. As the low pressure compressor wheel 25 is rotated, the blades of the compressor wheel compress the ambient air to a first pressure, such as a pressure of approximately 2 times atmospheric pressure (2 atm). This "low pressure" air is received in a low pressure volute 16, and from there it is routed via an interstage duct 17 into the inlet of a high pressure compressor wheel 30, which further compresses the air to a second pressure, such as a pressure of approximately 4 times atmospheric pressure (4 atm). This "high pressure" air is received by a high pressure volute 21 and is then fed to the cathode side of a fuel cell (not shown) via, where it provides oxygen for the fuel cell reaction to produce electricity.

As shown in FIG. 1, the compressor wheels 25, 30 are attached to opposite ends of a rotating shaft 35. In the case of a motor-driven dual-stage compressor, the shaft 35 may include a section having a magnet(s) 40 within or wrapped around the shaft that, in cooperation with a motor stator 45, drives the shaft. In this regard, the motor stator 45 may be opposingly disposed with respect to the shaft (e.g., spaced from and surrounding the shaft), such that an electric current (e.g., from the fuel cell) can rotate the shaft 35 to compress the air as described above. The shaft 35 may be supported within a housing 50 by a bearing assembly, such as an air bearing assembly.

Figures 2, 2A:
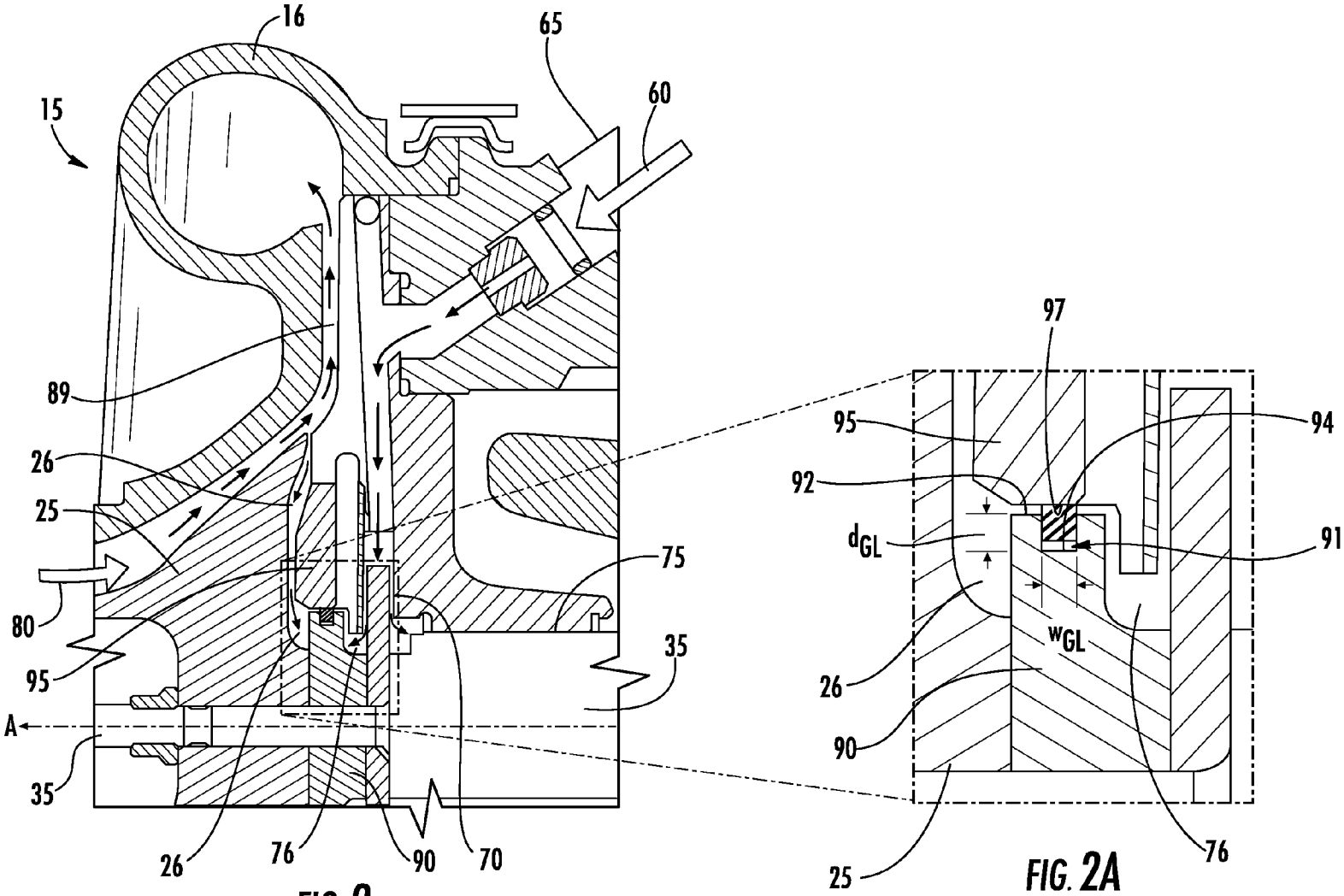
FIG. 2 is a simplified cross-sectional close-up view of a portion of a low pressure side of the compressor in accordance with one embodiment of the invention.
FIG. 2A is a detail cross-sectional view showing the sealing components of FIG. 2.

A simplified cross-section of a portion of the low pressure side 15 of the compressor 10 of FIG. 1, illustrating the various flow paths for routing air to different parts of the compressor, is shown in FIG. 2. As shown in FIG. 2, air (represented by arrow 80) at a temperature and pressure that may be different from atmospheric temperature and pressure is drawn into the low pressure side 15 of the compressor 10 via a low pressure compressor inlet 85 (shown in FIG. 1). When the compressor 10 is in operation, the air 80 from the low pressure compressor inlet 85 may be compressed to a higher pressure through rotation of the low pressure compressor wheel 25. Thus, rotation of the low pressure compressor wheel 25 compresses the air (e.g., to a pressure of approximately 2 atm) and the compressed air is discharged through a diffuser 89 into the low pressure volute 16 for subsequent delivery to the high pressure side 20 of the compressor via interstage duct 17 (shown in FIG. 1). Air compressed by the high pressure wheel 30 is discharged into the high pressure volute 21.

At the same time, a separate stream of air (represented by arrow 60) tapped off the high pressure compressed air stream is externally cooled and routed toward the fuel cell, at a pressure of, for example, about 4 atm, is supplied via a bearing inlet 65 into the low pressure side 15 of the compressor for use as coolant air in a thrust bearing 70 and/or a rotor air bearing 75. A thrust bearing 70 such as the one depicted in FIG. 2 may be provided to counteract the tendency of the shaft 35 to move towards the low pressure side 15 of the compressor 10 due to the pressure differential that exists between the high pressure side 20 (which may be at a pressure of, for example, 4 atm) and the low pressure side 15 (which may be at a pressure of, for example, 2 atm). Due to the configuration of the compressor and the spacing and positioning of components therein, including the thrust bearing 70 and the rotor air bearing 75, a space 76 may exist adjacent to the thrust bearing 70. The coolant air 60 and air coming off the thrust bearing 70 may be at pressures of approximate 3.5 atm, for example, and may accumulate in the space 76, as shown in FIG. 2.

With further reference to FIG. 2, a portion of the air 80 after it has been compressed is diverted from the stream going to the low pressure volute 16 and is instead routed through a leakage path between the back disk of the low pressure compressor wheel 25 and adjacent fixed structures into a space 26 behind the low pressure compressor wheel.

In the scenario described above, and with reference to FIG. 2A, the pressure in the space 26, which may be approximately 2 atm, is typically less than the pressure in the space 76, which may be approximately 3.5 atm. Thus, there is a tendency for the air 60 in the space 76 to find a path into the space 26, which holds air 80 at a lower pressure. Such a mingling of the different air streams at different pressures (and temperatures) may compromise the functions for which the different air streams are intended. For example, unrestricted flow of cooling air 60 into the space 26 may reduce the amount of cooling air 60 available for cooling the bearings 75 for the shaft.

To minimize the flow of air 80 from the space 76 into the low pressure side of the compressor 10, embodiments of the present invention provide a seal that is disposed between the space 26 behind the low pressure compressor wheel 25 and the space 76 adjacent the thrust bearing 70. Conventional methods of sealing may include contact type face seals or lip type seals; however, rotor speeds for turbomachinery including motor-driven staged compressors such as described above can be up to 100,000 RPM, far in excess of the speeds that can be managed by contact type face seals or lip type seals. Conventional shaft sealing may use labyrinth type seals; however, labyrinth type seals can be difficult and expensive to manufacture.

Figure 3:
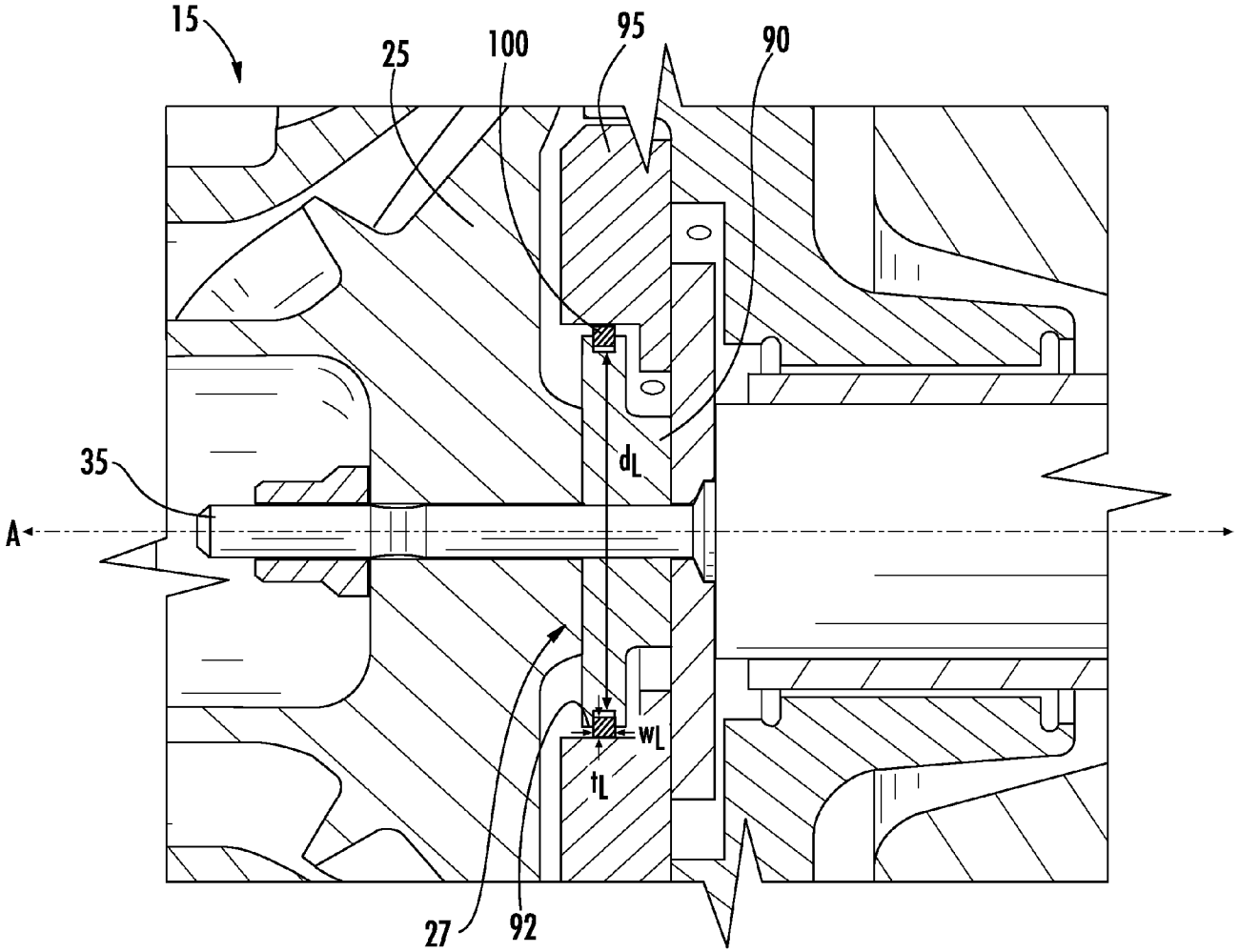
FIG. 3 is a simplified schematic view of the sealing components of the low pressure side of the compressor in accordance with one embodiment of the invention.

Accordingly, with reference now to FIG. 3, embodiments of a compressor 10 (shown in FIG. 1) for use with a fuel cell are provided that include a compressor wheel (such as the low pressure compressor wheel 25 described above and depicted in the figures) that is supported by a shaft 35 and is configured to rotate about an axis A of the shaft, as described above. The compressor may further include a seal carrier that is configured to rotate with the compressor wheel. A static seal plate may be disposed around a periphery of a portion of the seal carrier. In the low pressure side 15 of a dual-stage compressor such as the one shown in the figures, the seal carrier may be a low pressure seal carrier 90. The low pressure seal carrier 90 may be supported by the shaft 35 and may abut a back end 27 of the low pressure compressor wheel 25, such that rotation of the shaft 35 serves to rotate both the low pressure compressor wheel and the low pressure seal carrier. Moreover, in FIG. 3, the static seal plate may be a static low pressure seal plate 95 that surrounds the peripheral edge 92 of the low pressure seal carrier 90, as shown.

With reference to FIGS. 2A and 3, the seal carrier (e.g., the low pressure seal carrier 90) may include at least one seal groove 94 in the peripheral edge 92 of the seal carrier. At least one sealing ring 100 may be provided that is configured to be received within the corresponding seal groove 94, such that the sealing ring seals against a contact surface 97 of the static seal plate 95 when received in the groove 94 in order to create a pressure differential seal between a compressor side of the sealing ring (e.g., the space 26) and a shaft side of the sealing ring (e.g., the space 76).

Figure 4:
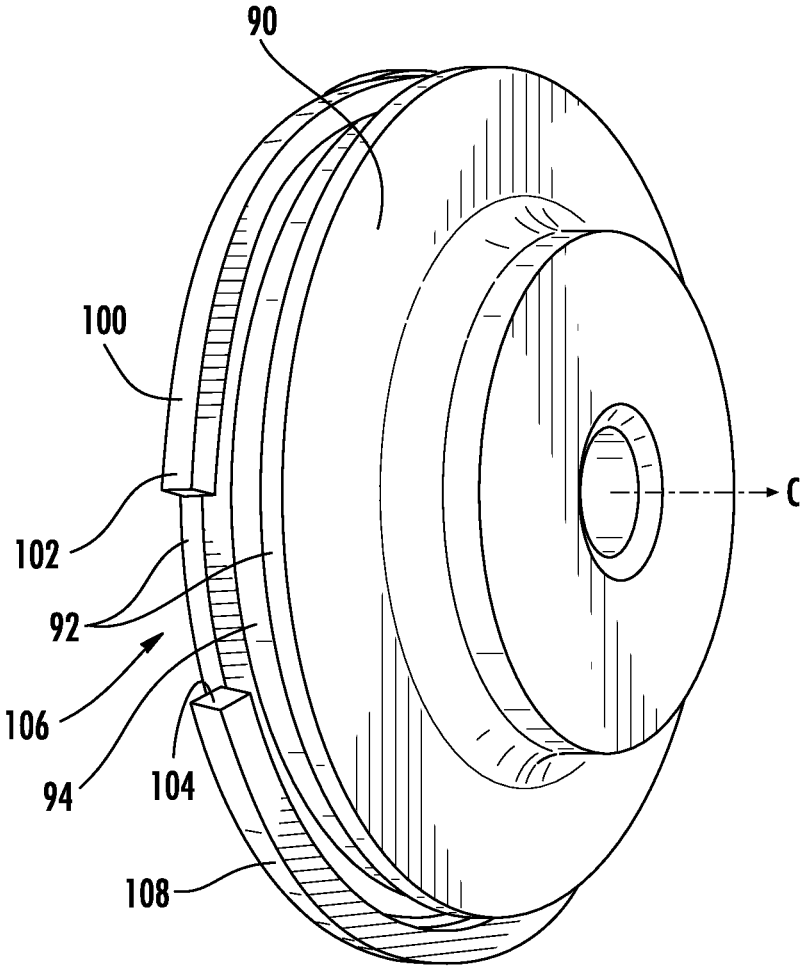
FIG. 4 is a perspective view of a sealing ring installed on a seal carrier in an unconstrained position in accordance with one embodiment of the invention.

One embodiment of the sealing ring 100 and seal carrier 90 is shown in FIG. 4. As depicted, the at least one sealing ring may comprise a split expansion ring. In this regard, the sealing ring may be a single piece of material, such as a low friction metallic material (e.g., stainless steel, cast iron, iron alloy, etc.), that defines two ends 102, 104 with a gap 106 therebetween. In an unconstrained state, such as when the sealing ring 100 is received by the groove 94 of the seal carrier 90, but before the seal carrier and sealing ring are disposed within the static seal plate 95, the gap 106 may be at a maximum size, such that a distance between the two ends 102, 104 of the sealing ring 100 is a maximum distance. When the seal carrier 90 and sealing ring 100 are installed in the compressor such that the static seal plate 95 is disposed in a surrounding relationship with respect to the peripheral edge 92 of the seal carrier and an outer edge 108 of the sealing ring 100, the sealing ring may be compressed towards a central axis C of the seal carrier 90 via contact between the outer edge 108 of the sealing ring and the contact surface 97 of the static seal plate 95 (shown in FIG. 2A). As a result, the gap 106 of the sealing ring 100 may be reduced to a width of, for example, a few thousandths of an inch when the seal carrier 90 and sealing ring 100 are in position with the static seal plate 95, as shown in FIGS. 2 and 2A.

Due to the tendency of the sealing ring 100 to be in the unconstrained state shown in FIG. 4 (e.g., the tendency to maximize the size of the gap 106), the sealing ring may act like a spring and may apply an outward force (e.g., a force in a radial direction away from the axis C shown in FIG. 4) on the contact surface 97 of the static seal plate 95 disposed around the periphery of the seal carrier 90. This outward force may enhance the engagement of the outer edge 108 of the sealing ring 100 with the contact surface 97 of the static seal plate 95, such that a stronger seal is achieved between the air 80 (FIG. 2) in the space 26 (FIGS. 2 and 2A) and the air 60 (FIG. 2) in the space 76 (FIGS. 2 and 2A). Thus, a gap 91 may exist between the sealing ring 100 and the circumferential surface of the groove 94, and the sealing ring 100 may be held static with the static seal plate 95 while the seal carrier 90 rotates with the shaft 35 when the compressor 10 is in operation.

In some cases, the seal carrier 90 may be constructed of a non-magnetic material, such as stainless steel or other non-magnetic metal. Furthermore, the static seal plate 95 may also be constructed of a non-magnetic material, such as stainless steel or other non-magnetic metal.

As described above, in embodiments in which the compressor is a dual-stage compressor as shown in FIG. 1, the compressor 10 may include a low pressure side 15 and a high pressure side 20. The low pressure side 15 may include a low pressure compressor wheel 25 supported by a shaft 35 and configured to rotate about the axis A of the shaft. The low pressure side 15 may also include a low pressure seal carrier 90 that is configured to rotate with the low pressure compressor wheel 25, and a static low pressure seal plate 95 disposed around a periphery of a portion of the rotating low pressure seal carrier, as well as at least one low pressure sealing ring 100.

Figures 5, 5A:
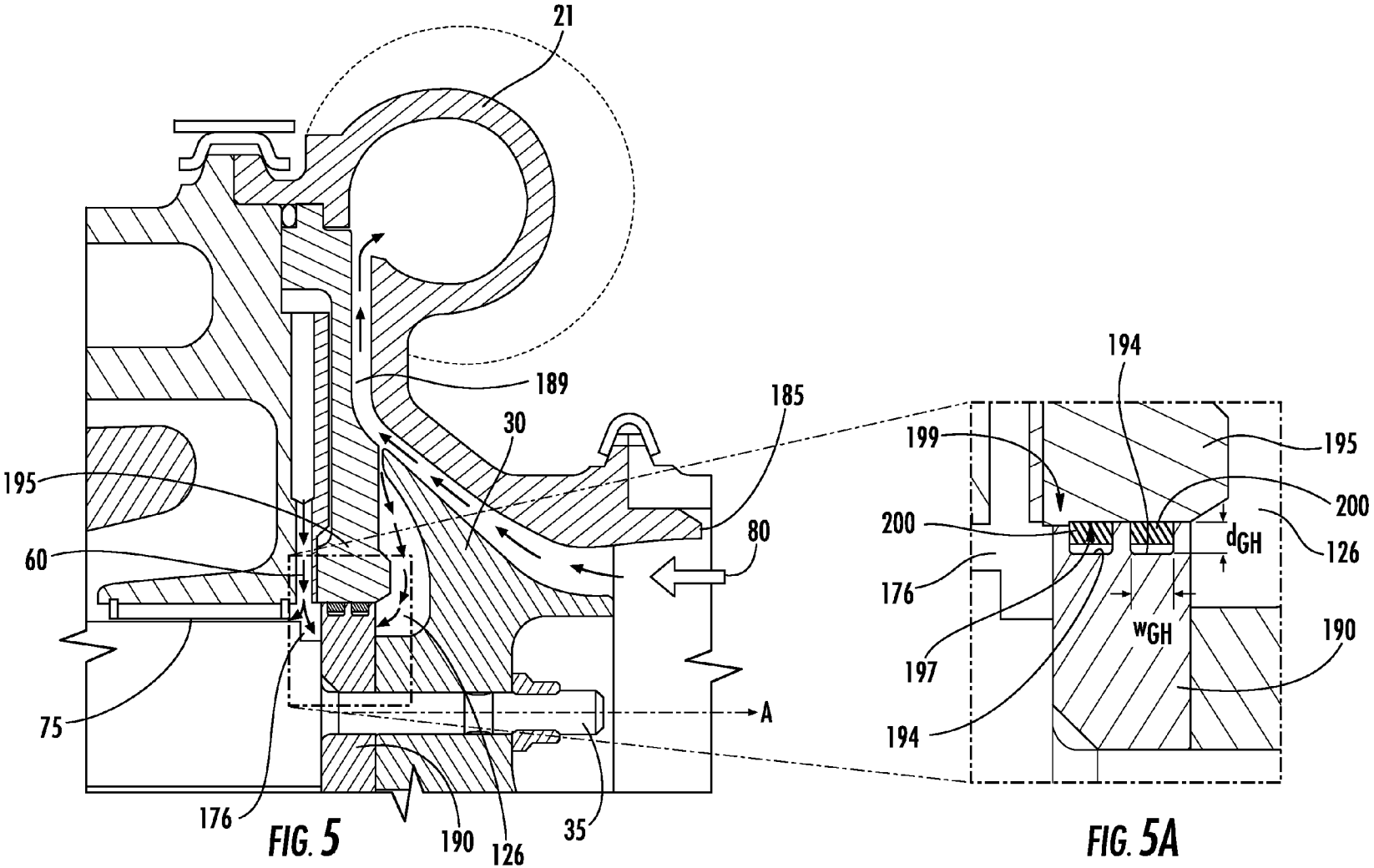
FIG. 5 is a simplified cross-sectional close-up view of a portion of a high pressure side of the compressor in accordance with one embodiment of the invention.
FIG. 5A is a detail cross-sectional view showing the sealing components of FIG. 5.

In addition, the dual-stage compressor 10 may further comprise a high pressure side 20 that includes a high pressure compressor wheel 30 that is supported by the shaft 35 and is configured to rotate about the axis A of the shaft, as shown in FIG. 5. With respect to the high pressure side 20, and as described above with reference to FIG. 1, air 80 that has been compressed by the low pressure compressor wheel 25 to a pressure of about 2 atm is delivered to the high pressure compressor wheel 30 for further compression via the interstage duct 17 and a high pressure compressor inlet 185. When the compressor 10 is in operation, the air 80 from the high pressure compressor inlet 185 may be compressed to an even higher pressure through rotation of the high pressure compressor wheel 30. Thus, rotation of the high pressure compressor wheel 30 further compresses the air (e.g., to a pressure of approximately 4 atm) and the air is discharged through a diffuser 189 into the high pressure volute 21 for subsequent delivery to the fuel cell (not shown).

As the air 80 is routed towards the high pressure volute 21, and as described above with respect to the low pressure side 15, a portion of the air 80 after it has been further compressed by the high pressure compressor wheel 30 may be diverted from the stream going to the high pressure volute 21 and may instead be routed through a leakage path into a space 126 behind the high pressure compressor wheel 30. At the same time, air 60 from the rotor air bearing 75 on the high pressure side 20 of the shaft 35 may enter the space 176. As noted above, the air 60 from the rotor air bearing 75 may be at a pressure of approximately 3.5 atm. With reference to FIG. 5A, the pressure in the space 126, which is approximately 4 atm, may thus be greater than the pressure in the space 176, which is approximately 3.5 atm. Accordingly, there may be a tendency for the air 80 in the space 126 to find a path into the space 176, which holds air 60 at a lower pressure. As described above with respect to the low pressure side 15, a mingling of the different air streams at different pressures (and temperatures) may again be undesirable as it may disrupt the functions for which the different air streams are intended. For example, an increase in pressure in the space 176 may negatively affect the function of the rotor air bearing 75 shown in FIG. 5.

Thus, in order to minimize the flow of air 80 from the space 126 into other spaces, gaps, and clearances between other components of the compressor 10, embodiments of the present invention may further provide a seal that is disposed between the space 126 behind the high pressure compressor wheel 30 and the space 176 adjacent the rotor air bearing 75 on the high pressure side 20, in addition to or instead of the seal described above with respect to the low pressure side 15 and shown in FIGS. 2, 2A, and 3.

Figure 6:
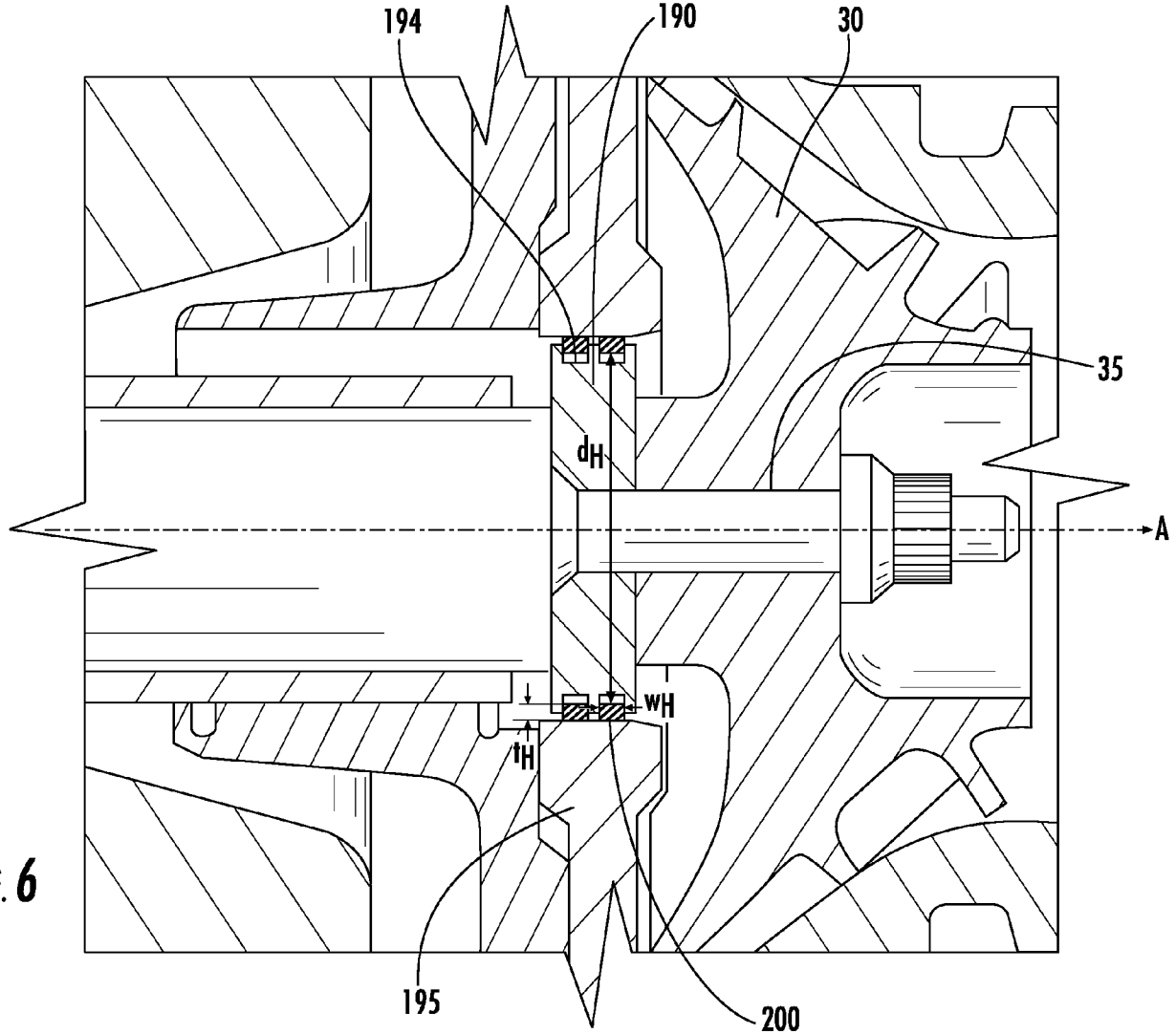
FIG. 6 is a simplified schematic view of the sealing components of the high pressure side of the compressor in accordance with one embodiment of the invention.

Turning to FIGS. 5 and 6, a high pressure seal carrier 190 may be provided that is supported by the shaft 35, such that the high pressure seal carrier is configured to rotate with the high pressure compressor wheel 125 upon rotation of the shaft. A static high pressure seal plate 195 may be disposed around a periphery of a portion of the high pressure seal carrier 190. Thus, the high pressure seal carrier 190 may be configured to rotate within and with respect to the static high pressure seal plate 195 as a result of rotation of the shaft 35.

Similar to the low pressure side 15 described above, the high pressure seal carrier 190 may include at least one seal groove 194 (best shown in FIG. 5A). A high pressure sealing ring 200 may be provided, and the groove 194 of the high pressure seal carrier 190 may be configured to receive the high pressure sealing ring 200, such that the sealing ring is configured to seal against a contact surface 197 of the static high pressure seal plate 195 when received in the groove in order to create a pressure differential seal for the high pressure side 20.

Figure 7:
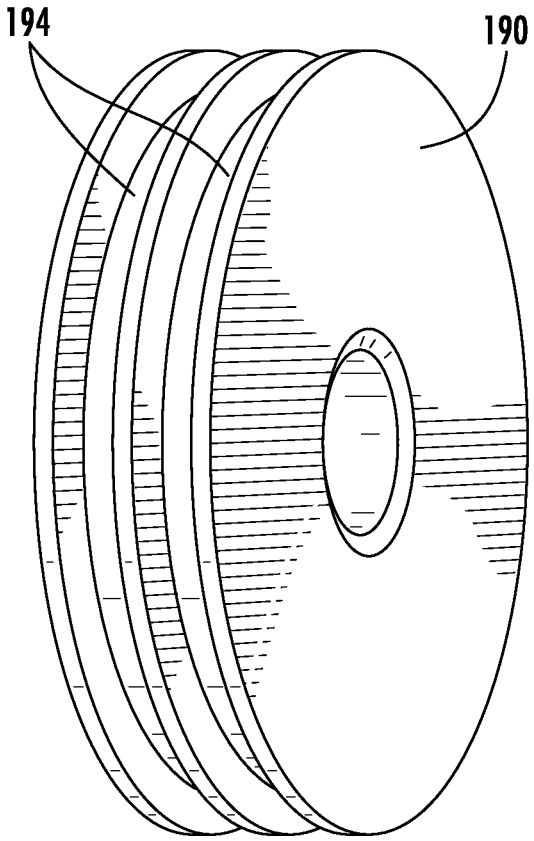
FIG. 7 is a perspective view of a high pressure seal carrier with two grooves in accordance with an embodiment of the invention.

In the depicted embodiment, the high pressure seal carrier 190 includes two seal grooves 194 spaced apart from each other. Each seal groove 194 may be configured to receive a single high pressure sealing ring 200. Two seal grooves 194 receiving two high pressure sealing rings 200 may be provided in the high pressure side 20 in order to provide a more effective seal in view of the elevated temperature conditions resulting from the compression of air to higher pressures as compared to the pressures that exist on the low pressure side 15 of the compressor 10. For example, the temperature of the compressed air streams 60, 80 on the high pressure side 20 may be approximately 130° C.-300° C. or more. One embodiment of the high pressure seal carrier 190 having two spaced apart seal grooves 194 is shown in FIG. 7, as an example.

Figure 8:
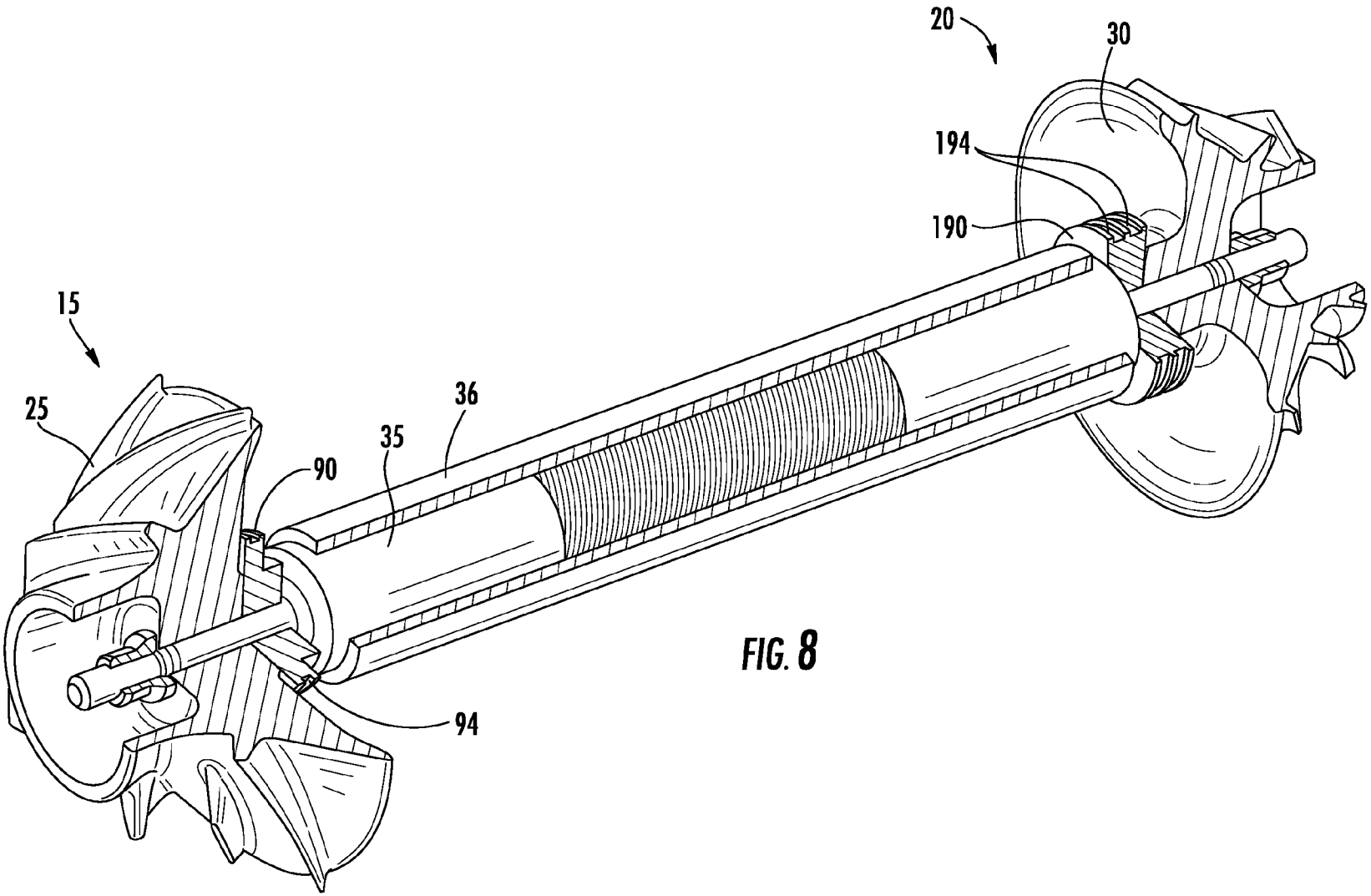
FIG. 8 is a perspective view of a shaft with a low pressure compressor wheel and a high pressure compressor wheel and corresponding seal carriers in accordance with an embodiment of the invention.

With reference to FIG. 8, a simplified perspective view of the shaft 35 having a low pressure compressor wheel 25 on a low pressure side 15 of the shaft and a high pressure compressor wheel 30 on a high pressure side 20 of the shaft is shown. A low pressure seal carrier 90 is provided on the low pressure side 15 adjacent the low pressure compressor wheel 25, and a high pressure seal carrier 190 is provided on the high pressure side 20 adjacent the high pressure compressor wheel 30. A journal sleeve 36 (at least a portion of which may form an air bearing 75 for the shaft 35) may extend between the low pressure and high pressure seal carriers 90, 190. As depicted, the low pressure seal carrier 90 may include a single groove 94 for receiving a single sealing ring 100, and the high pressure seal carrier 190 may include two grooves 194 for receiving two sealing rings 200, one in each groove.

As described above with respect to the low pressure sealing ring 100, the high pressure sealing rings 200 may be constructed of a low friction metallic material, such as, for example, stainless steel, cast iron, iron alloys, etc. The high pressure sealing rings 200 may, in some embodiments, comprise a split expansion ring, as described above with respect to the low pressure sealing ring 100. Thus, at least one of the low pressure sealing ring 100 or the high pressure sealing rings 200 may be split expansion rings that are configured to be outwardly biased when installed on the respective seal carriers 90, 190 and disposed within the respective static seal plates 95, 195, so as to promote engagement and sealing between the outer edges of the sealing rings 100, 200 and the corresponding contact surfaces 97, 197 of the respective seal carriers 90, 190. Furthermore, as described above with respect to the low pressure side 15, the high pressure seal carrier 190 and/or the static high pressure seal plate 195 may be constructed of non-magnetic materials.

With reference now to FIG. 5A, in some embodiments, the static high pressure seal plate 195 may include a stepped section 199 (e.g., a stepped seal bore diameter) on the contact surface 197 thereof. The stepped section 199 may be configured to limit axial travel of the high pressure sealing ring 200. In the depicted embodiment of FIG. 5A, for example, the stepped section 199 may be configured to limit travel of the sealing ring 200 (e.g., the sealing ring 200 abutting the stepped section 199) along an axis parallel to the axis A of the shaft 35 (shown in FIG. 5) towards the low pressure side 15 of the compressor (e.g., towards the space 176). In particular, in some embodiments in which the high pressure side 20 includes two high pressure sealing rings 200, as shown in FIG. 5A, one of the sealing rings may be an inner high pressure sealing ring and the other may be an outer high pressure sealing ring. In FIG. 5A, for example, the high pressure sealing ring 200 closest to the space 176 may be the inner high pressure sealing ring, and the high pressure sealing ring closest to the space 126 may be the outer high pressure sealing ring. The high pressure seal carrier 190 may thus include an inner seal groove 194 configured to receive the inner high pressure sealing ring 200 and an outer seal groove, spaced apart from the inner seal groove, configured to receive the outer high pressure sealing ring. The stepped section 199 of the static high pressure seal plate 190 may thus be configured to abut the inner high pressure sealing ring 200 so as to limit axial travel of the inner high pressure sealing ring in a direction towards the low pressure side 15 of the compressor. In contrast, in some embodiments, the outer high pressure sealing ring 200 may be allowed to "float" and may not abut any stepped section of the static high pressure seal plate 190. Due to the lower differential pressure across the outer high pressure sealing ring, the outer high pressure sealing ring may have a lesser tendency to travel in an axial direction than the inner high pressure sealing ring and may, thus, not need to abut a stepped section to limit such movement.

In some embodiments, the high pressure sealing ring(s) 200 (shown, e.g., in FIG. 6) may have a diametral size that differs from a diametral size of the low pressure sealing ring(s) 100 (shown, e.g., in FIG. 3). For example, the diametral size of the high pressure sealing rings 200 may be smaller than the diametral size of the low pressure sealing ring in an effort to minimize rotor axial thrust that may be caused by differences in the diameters of the high and low pressure compressor wheels. In some cases, the diametral size $d_H$ of the high pressure sealing rings 200, which may be the outer diameter of the sealing rings in the constrained position, may be approximately ⅝-inch to approximately 2 inches, whereas the diametral size dL (e.g., the outer diameter as shown in FIG. 3) of the low pressure sealing ring 100 may be approximately 1 inch to approximately 2½ inches. Although the diametral size is depicted in FIGS. 3 and 6 as being the outer diameter of the respective sealing rings 100, 200, the diametral size may, in some cases, be considered the inner diameter of the sealing rings 100, 200 or a nominal diameter, in the constrained or unconstrained positions. In this regard, the sealing rings 100, 200 may be sized to take into account the different pressures and temperatures in the low pressure side 15 and the high pressure side 20, such that the thrust load of the shaft 35 due to the different pressures may be balanced.

With reference to FIGS. 3 and 6, the widths $w_L$, $w_H$ and thicknesses $t_L$, $t_H$ of the sealing rings 100, 200 may also vary depending on the parameters and specific configuration of the compressor 10. In some embodiments, for example, the width $w_L$ of the sealing ring 100 on the low pressure side 15 may be approximately 1 mm to approximately 4 mm, and the thickness $t_L$ of the sealing ring 100 on the low pressure side 15 may be approximately 1 mm to approximately 3 mm. The width $w_H$ of the sealing ring 200 on the high pressure side 20 may be approximately 1 mm to approximately 4 mm, and the thickness $t_H$ of the sealing ring 200 on the high pressure side 20 may be approximately 1 mm to approximately 4 mm. In some cases, the sealing ring aspect ratios are approximately 1:1.

Referring to FIGS. 2A and 5A, the seal grooves 94, 194 on the respective seal carriers 90, 190 of the low pressure side 15 and the high pressure side 20 may be sized to accommodate the respective sealing rings 100, 200 to be received therein. In this regard, for example, the seal groove 94 on the low pressure seal carrier 90 may have a depth $d_{GL}$ and a width $w_{GL}$, and the seal groove 194 on the high pressure seal carrier 190 may have a depth $d_{GH}$ and a width $w_{GH}$, where the dimensions of the seal grooves 94, 194 are sized larger than the corresponding dimensions of the sealing rings 100, 200 to accommodate axial and radial rotor motion and machining tolerances. In some cases, the sealing rings 100, 200 and the corresponding grooves 94, 194 may be sized to optimize the mechanical fit of the rings within the grooves with respect to tolerance and rotor end play, so as to achieve the best sealing potential. Moreover, the sealing rings 100, 200 and their grooves 94, 194 can be sized so as to provide a known pressure difference across the sealing rings, as well as to provide an orificed flow path from one side of the sealing ring to the other, if desired. For example, by manufacturing the smallest size orifice possible, the flow path can be minimized to achieve a maximum pressure difference across the sealing rings.

Accordingly, as described above, embodiments of the invention provide a low-cost, low-friction mechanism for differential pressure sealing in a compressor, such as a dual-stage compressor used for fuel cell applications. Although the example of a dual-stage compressor is illustrated in the accompanying figures and described above, embodiments of the invention may also be application in single-stage compressors or multiple-stage compressors having different configurations than the one described above.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A dual-stage compressor for use with a fuel cell, said dual-stage compressor comprising:

a low pressure side comprising:

a low pressure compressor wheel supported by a shaft and configured to rotate about an axis of the shaft;

a low pressure seal carrier configured to rotate with the low pressure compressor wheel;

a static low pressure seal plate disposed around a periphery of a portion of the low pressure seal carrier; and at least one low pressure sealing ring;

a high pressure side comprising:

a high pressure compressor wheel supported by the shaft and configured to rotate about the axis of the shaft;

a high pressure seal carrier configured to rotate with the high pressure compressor wheel;

a static high pressure seal plate disposed around a periphery of a portion of the high pressure seal carrier; and at least one high pressure sealing ring, wherein the low pressure seal carrier defines at least one seal groove configured to receive the low pressure sealing ring, the low pressure sealing ring being configured to seal against a contact surface of the static low pressure seal plate when received in the groove in order to create a pressure differential seal for the low pressure side, wherein the high pressure seal carrier defines at least one seal groove configured to receive the high pressure sealing ring, the high pressure sealing ring being configured to seal against a contact surface of the static high pressure seal plate when received in the groove in order to create a pressure differential seal for the high pressure side, wherein the static high pressure seal plate includes a stepped section on the contact surface thereof, wherein the stepped section is configured to limit axial travel of the high pressure sealing ring, and wherein the high pressure side comprises an inner high pressure sealing ring and an outer high pressure sealing ring, wherein the high pressure seal carrier defines an inner seal groove configured to receive the inner high pressure sealing ring and an outer seal groove, spaced apart from the inner seal groove, configured to receive the outer high pressure sealing ring, and wherein the stepped section of the static high pressure seal plate is configured to abut the inner high pressure sealing ring so as to limit axial travel of the inner high pressure sealing ring in a direction towards the low pressure side.

2. The dual-stage compressor of claim 1, wherein at least one of the low pressure sealing ring or the high pressure sealing ring comprises a split expansion ring.

3. The dual-stage compressor of claim 1, wherein the low pressure seal carrier defines only one seal groove configured to receive a single low pressure sealing ring, and the high pressure seal carrier defines two seal grooves spaced apart from each other and each configured to receive a single high pressure sealing ring.

4. The dual-stage compressor of claim 1, wherein the low pressure sealing ring and the high pressure sealing ring are constructed of a low friction metallic material.

5. The dual-stage compressor of claim 1, wherein the at least one high pressure sealing ring has a diametral size that is different than a diametral size of the at least one low pressure sealing ring.

6. The dual-stage compressor of claim 5, wherein the diametral size of the at least one high pressure sealing ring is smaller than the diametral size of the at least one low pressure sealing ring.

7. The dual-stage compressor of claim 1, wherein the low pressure seal carrier and the high pressure seal carrier are constructed of non-magnetic materials.

8. The dual-stage compressor of claim 1, wherein the static low pressure seal plate and the static high pressure seal plate are constructed of non-magnetic materials.

9. A compressor for use with a fuel cell, said compressor comprising:

a compressor wheel supported by a shaft and configured to rotate about an axis of the shaft;

a seal carrier configured to rotate with the compressor wheel, wherein the seal carrier defines at least one seal groove in a peripheral edge of the seal carrier;

a static seal plate disposed around a periphery of a portion of the seal carrier; and at least one sealing ring configured to be received within the corresponding seal groove, such that the sealing ring seals against a contact surface of the static seal plate when received in the groove in order to create a pressure differential seal between a compressor side of the sealing ring and a shaft side of the sealing ring, wherein the static seal plate includes a stepped section on the contact surface thereof, wherein the stepped section is configured to limit axial travel of the sealing ring, and wherein the at least one sealing ring comprises an inner sealing ring and an outer sealing ring, wherein the seal carrier includes an inner seal groove configured to receive the inner sealing ring and an outer seal groove, spaced apart from the inner seal groove, configured to receive the outer sealing ring, and wherein the stepped section of the static seal plate is configured to abut the inner sealing ring so as to limit axial travel of the inner sealing ring.

10. The compressor of claim 9, wherein the at least one sealing ring comprises a split expansion ring.

11. The compressor of claim 9, wherein the seal carrier defines two seal grooves spaced apart from each other and each configured to receive a single sealing ring.

12. The compressor of claim 9, wherein the sealing ring is constructed of a low friction metallic material.

13. The compressor of claim 9, wherein the seal carrier is constructed of a non-magnetic material.

14. The compressor of claim 9, wherein the static seal plate is constructed of a non-magnetic material.

* * * * *